US009484658B2

(12) United States Patent
Nakashima et al.

(10) Patent No.: US 9,484,658 B2
(45) Date of Patent: Nov. 1, 2016

(54) CONNECTOR WITH A RECTANGULAR TAB INSERTION HOLE AND A DETECTION PROBE INSERTION HOLE COMMUNICATING WITH A CORNER REGION OF THE TAB INSERTION HOLE

(71) Applicant: Sumitomo Wiring Systems, Ltd., Yokkaichi, Mie (JP)

(72) Inventors: Keita Nakashima, Mie (JP); Shinji Iihoshi, Mie (JP)

(73) Assignee: SUMITOMO WIRING SYSTEMS, LTD., Yokkaichi (JP)

( * ) Notice: Subject to any disclaimer, the term of this patent is extended or adjusted under 35 U.S.C. 154(b) by 0 days.

(21) Appl. No.: 14/772,097

(22) PCT Filed: Dec. 4, 2013

(86) PCT No.: PCT/JP2013/082632

§ 371 (c)(1),
(2) Date: Sep. 2, 2015

(87) PCT Pub. No.: WO2014/147895

PCT Pub. Date: Sep. 25, 2014

(65) Prior Publication Data

US 2016/0013576 A1 Jan. 14, 2016

(30) Foreign Application Priority Data

Mar. 18, 2013 (JP) ..... 2013-055781

(51) Int. Cl.

| | |
|---|---|
| ***H01R 13/40*** | (2006.01) |
| ***H01R 13/436*** | (2006.01) |
| ***H01R 13/42*** | (2006.01) |
| *H01R 13/64* | (2006.01) |
| *H01R 13/631* | (2006.01) |
| *H01R 107/00* | (2006.01) |
| *H01R 11/18* | (2006.01) |

(52) U.S. Cl.

CPC ..... *H01R 13/4367* (2013.01); *H01R 13/42* (2013.01); *H01R 11/18* (2013.01); *H01R 13/631* (2013.01); *H01R 13/64* (2013.01); *H01R 2107/00* (2013.01); *H01R 2201/20* (2013.01)

(58) Field of Classification Search

CPC ..... G01R 1/0425; H01R 2201/20; H01R 13/4223; H01R 13/4226; H01R 13/4362

USPC ..... 439/912, 595, 744; 324/538

See application file for complete search history.

(56) References Cited

U.S. PATENT DOCUMENTS 6,796,836 B2 * 9/2004 Ichida ..... H01R 13/113 439/595
7,252,561 B2 * 8/2007 Nora ..... H01R 13/4223 439/852

(Continued)

FOREIGN PATENT DOCUMENTS

JP 8-306423 11/1996
JP 2004-47269 2/2004

(Continued)

OTHER PUBLICATIONS

International Search Report.

*Primary Examiner* — Abdullah Riyami
*Assistant Examiner* — Thang Nguyen
(74) *Attorney, Agent, or Firm* — Gerald E. Hespos; Michael J. Porco; Matthew T. Hespos

(57) ABSTRACT

A connector (C) includes a housing (20) formed with terminal accommodation chambers (22). Terminal fittings (10) are inserted into the terminal accommodation chambers (22) from behind. Rectangular tab insertion holes (24) penetrates through a front wall (23) of the housing (20) and allow tabs (61) to be inserted into the terminal accommodation chambers (22). Guide slopes (29, 30) are formed by recessing and tapering an opening edge part of the tab insertion hole (22) on a front surface of the front wall (23). Detection holes (31) penetrate through the front wall (23) and communicate with corner parts of the tab insertion holes (24) so that a probe (50) for conduction test can be inserted into the terminal accommodation chambers (22) from the front.

9 Claims, 4 Drawing Sheets

(56) References Cited

U.S. PATENT DOCUMENTS

| | | | | |
|---|---|---|---|---|
| 2006/0170429 | A1* | 8/2006 | Nakamura | H01R 13/4534 324/538 |
| 2013/0120000 | A1* | 5/2013 | Kida | H01R 13/193 324/538 |

FOREIGN PATENT DOCUMENTS

| | | |
|---|---|---|
| JP | 2006-216308 | 8/2006 |
| JP | 2007-173216 | 7/2007 |
| JP | 2009-129626 | 6/2009 |

* cited by examiner

CONNECTOR WITH A RECTANGULAR TAB INSERTION HOLE AND A DETECTION PROBE INSERTION HOLE COMMUNICATING WITH A CORNER REGION OF THE TAB INSERTION HOLE

BACKGROUND

1. Field of the Invention

The present invention relates to a connector.

2. Description of the Related Art

Japanese Unexamined Patent Publication No. H08-306423 discloses a connector capable of detecting an inserted state of a terminal fitting into a housing. The housing is formed, on the front end surface thereof, with a detection hole communicating with the interior of a terminal accommodation chamber (cavity in Japanese Unexamined Patent Publication No. H08-306423), and a conduction test is conducted by inserting a probe into the detection hole (cut in Japanese Unexamined Patent Publication No. H08-306423) from the front of the housing. By the conduction test, it is possible to detect whether or not the terminal fitting is inserted in the terminal accommodation chamber and whether or not the terminal fitting is properly inserted in a predetermined terminal accommodation chamber.

Further, the housing is formed, on the front end surface thereof, with a rectangular tab insertion hole (communication window in Japanese Unexamined Patent Publication No. H08-306423) communicating with the terminal accommodation chamber, and a tab of a mating terminal is inserted into the terminal accommodation chamber through the tab insertion hole to be connected to the terminal fitting. Since the terminal fitting is miniaturized in this connector, dimensional differences between outer shape dimensions of the terminal fitting and opening dimensions of the tab insertion hole are small. Thus, the detection hole is formed by cutting an edge part constituting a rectangular opening edge part of the tab insertion hole.

In the above connector, a guide slope is formed by cutting the opening edge part of the tab insertion hole into a tapered shape on the front end surface of the housing. This guide slope exhibits a function of guiding the tab when the tab of the mating terminal is inserted into the tab insertion hole. Accordingly, the guide slope is preferably formed over the entire circumference of the opening edge part of the tab insertion hole. However, the detection hole is formed by cutting only one edge part of the rectangular opening edge part of the tab insertion hole. Thus, the guide slope cannot be ensured in a wide range on the edge part, where the detection hole is formed, out of the opening edge part of the tab insertion hole.

The present invention was completed based on the above situation and aims to ensure a wide formation range of a guide slope on an opening edge part of a tab insertion hole in a connector in which the tab insertion hole and a detection hole communicate.

SUMMARY

The present invention is directed to a connector, including a housing formed with a terminal accommodation chamber. A terminal fitting is to be inserted into the terminal accommodation chamber from behind. A rectangular tab insertion hole penetrates through a front wall of the housing and allows a tab of a mating terminal to be inserted into the terminal accommodation chamber from the front. A guide slope is formed by recessing and tapering an opening edge part of the tab insertion hole on a front surface of the front wall. A detection hole penetrates through the front wall, communicates with a corner part of the tab insertion hole and allows a probe for conduction test to be inserted into the terminal accommodation chamber from front.

On two edge parts connected to the detection hole out of four edge parts constituting the opening edge part of the tab insertion hole, areas cut by the detection hole can be small as compared with the case where the detection hole is allowed to communicate with only one edge part. Thus, according to the present invention, it is possible to ensure a formation area of the guide surface on the edge part connected to the detection hole out of the opening edge part of the tab insertion hole over a wide range.

The connector may be configured so that, on an edge part connected to the detection hole out of four edge parts constituting the opening edge part of the tab insertion hole, a formation area of the guide slope in a direction perpendicular to a length direction of the edge part is in a range smaller than an opening area of the detection hole. It is preferable to suppress a reduction in the strength of the front wall. Accordingly, the formation area of the guide surface in the direction perpendicular to the edge part connected to the detection hole is set in the range smaller than the opening area of the detection hole on that edge part. This makes a part of the end of the edge part of the front wall facing the detection hole thick without forming the guide surface so that a reduction in strength is suppressed.

An end of the edge part that faces the detection hole may be cantilevered in a part of the front wall where the tab insertion hole and the detection hole communicate.

An area of an inner surface of the detection hole that defines an end surface of an edge part constituting the opening edge part of the tab insertion hole may be a flat surface perpendicular to a length direction of the edge part. Thus, the formation area of the guide surface of the edge part connected to the detection hole in the length direction of that edge part can be ensured.

The connector of the present invention may be configured such that an inner surface of the detection hole and an inner surface of the terminal accommodation chamber are connected flush with each other. Accordingly there is no step between the inner surface of the detection hole and the inner surface of the terminal accommodation chamber. As a result, a probe can reach the front end of the terminal fitting without being caught even if the front end of the terminal fitting is located slightly behind the front end of the terminal accommodation chamber.

DETAILED DESCRIPTION

Figure 1:
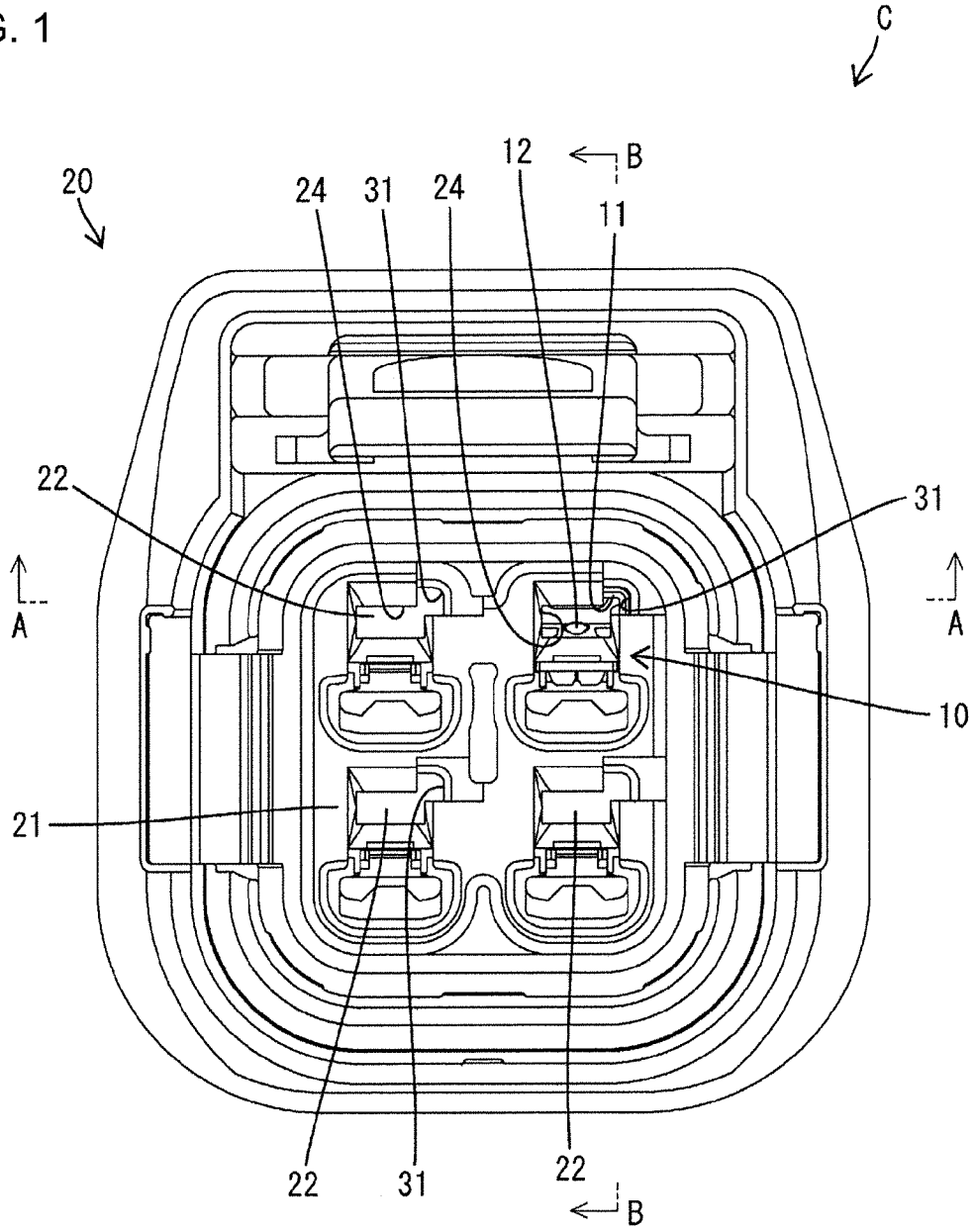
FIG. 1 is a front view of an embodiment.
Figure 3:
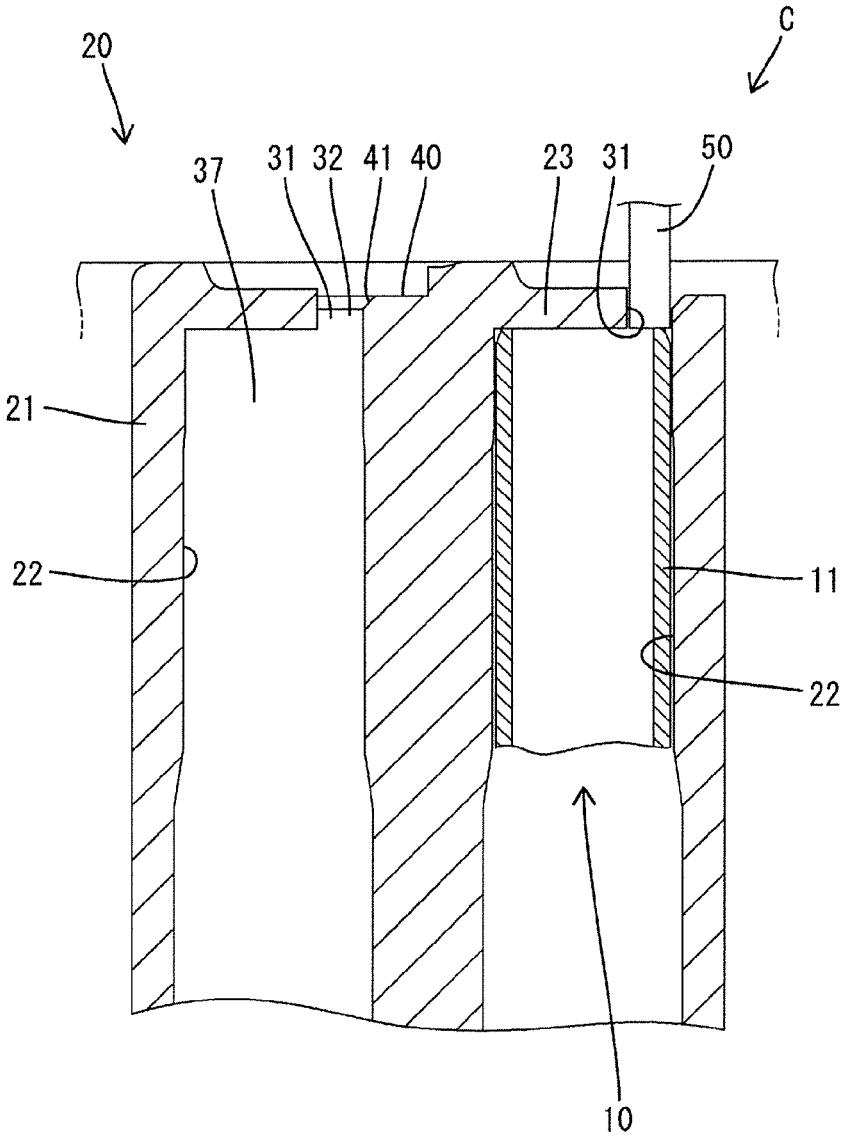
FIG. 3 is a partial enlarged section along A-A of FIG. 1.
Figure 4:
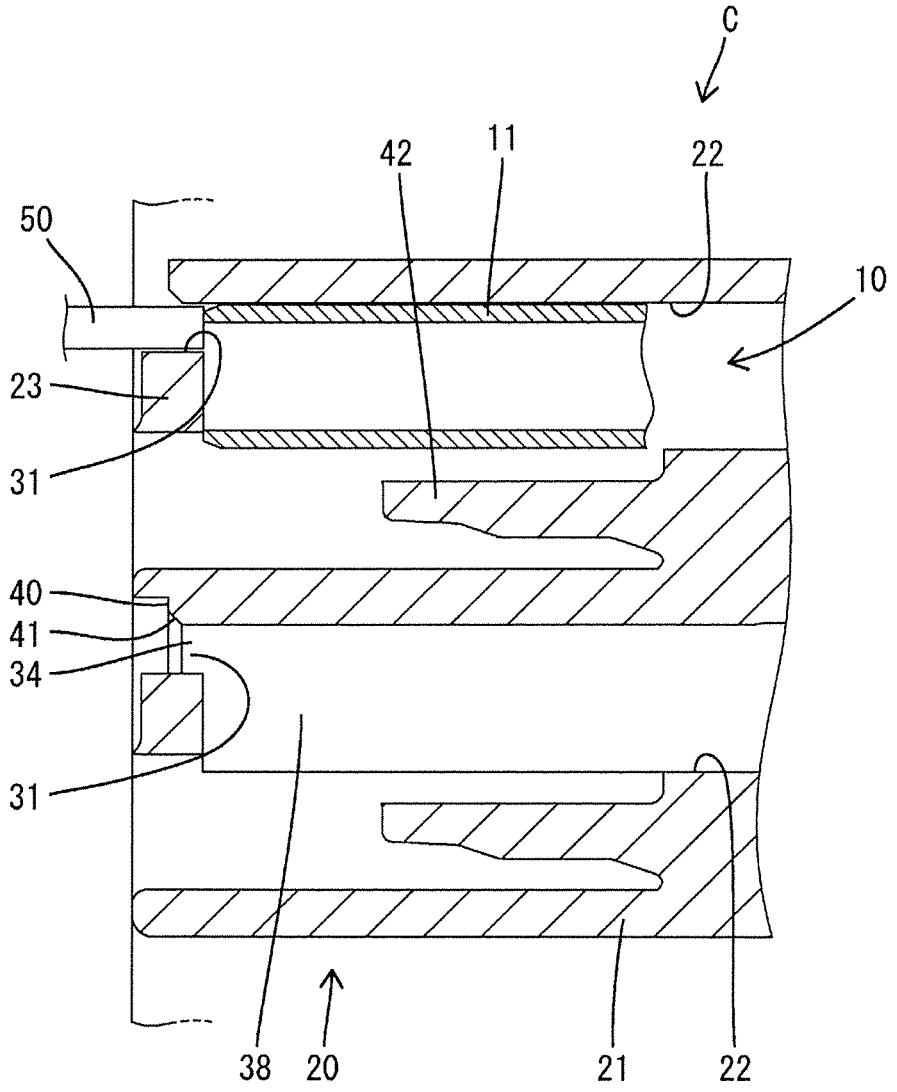
FIG. 4 is a partial enlarged section along B-B of FIG. 1.

Hereinafter, a specific embodiment of the present invention is described with reference to FIGS. 1 to 4. A connector C of this embodiment includes terminal fittings 10 and a housing 20 made of synthetic resin for accommodating the terminal fittings 10. As shown in FIGS. 3 and 4, the terminal fitting 10 is a female terminal fitting long and narrow in a front-back direction as a whole. A rectangular tube portion 11 is formed at a front end part of the terminal fitting 10. As shown in FIG. 1, a resilient contact piece 12 is accommodated in the rectangular tube portion 11. Further, a probe 50 to be described later is brought into contact with a right-upper corner part of the front end surface of the rectangular tube portion 11 in a front view.

The housing 20 includes a terminal holding portion 21 having a block-like shape as a whole. As shown in FIG. 1, a plurality of (four in this embodiment) terminal accommodation chambers 22 penetrating in the front-back direction are formed in the terminal holding portion 21 while being vertically and laterally aligned. As shown in FIGS. 3 and 4, a front end part of the terminal accommodation chamber 22 is covered with a front wall portion 23 except at a tab insertion hole 24 and a detection hole 31 to be described later. The front wall portion 23 constitutes the front end surface of the housing 20. A cross-sectional shape of the inner periphery of the terminal accommodation chamber 22 when the front end part of the terminal accommodation chamber 22 is cut perpendicular to the front-back direction is substantially square.

Figure 2:
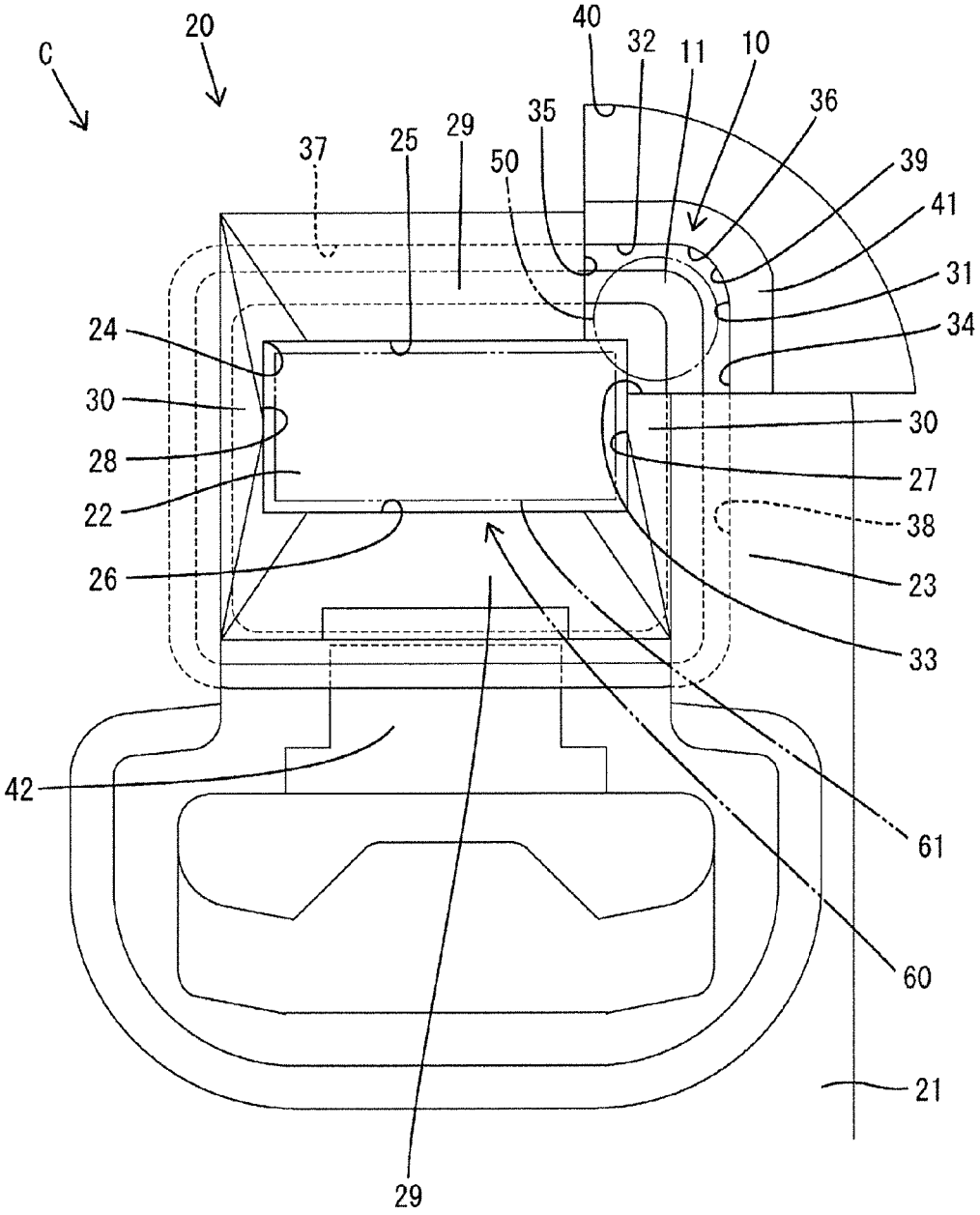
FIG. 2 is a partial enlarged view of FIG. 1.

As shown in FIG. 2, the front wall portion 23 is formed with the tab insertion holes 24 having a laterally long rectangular shape when viewed from front and individually corresponding to the respective terminal accommodation chambers 22. The tab insertion hole 24 penetrates into the terminal accommodation chamber 22 from the front surface of the front wall portion 23 (housing 20). An opening area of the tab insertion hole 24 in a width direction (lateral direction) is within the range of the entire width of the terminal accommodation chamber 22 and a width of the tab insertion hole 24 is smaller than that of the front end part of the terminal accommodation chamber 22. An opening area of the tab insertion hole 24 in a height direction (vertical direction) is within the range of the entire height of the terminal accommodation chamber 22 and a height of the tab insertion hole 24 is smaller than that of the front end part of the terminal accommodation chamber 22.

The rectangular opening edge part of the tab insertion hole is composed of an upper edge part 25, a lower edge part 26, a right edge part 27 (edge part connected to the detection hole in claims) and a left edge part 28. A rectangular area of the front wall portion 23 along the above four edge parts 25 to 28 functions as a front stop portion except in a formation area of the detection hole 31 to be described later. That is, the front wall portion 23 is arranged to extend along all the four edge parts 25 to 28 constituting the opening edge of the tab insertion hole 24. This front wall portion 23 functions as a means for stopping the terminal fitting 10 inserted into the terminal accommodation chamber 22 to prevent any further forward movement.

As shown in FIG. 2, a tab 61 of a mating terminal 60 is inserted into the tab insertion hole 24 from the front of the housing 20. On the front surface of the front wall portion 23, a pair of upper and lower first guide slopes 29 and a pair of left and right second guide slopes 30 recessed and tapered are formed as a means for guiding the tab 61 into the tab insertion hole 24 when the tab 61 is vertically and/or laterally displaced with respect to the tab insertion hole 24. The first guide slopes 29 are formed to extend along the upper and lower edge parts 25, 26 and the second guide slopes 30 are formed to extend along the right and left edge parts 27, 28. Vertical formation areas of the first guide slopes 29 along the upper and lower edge parts 25, 26 are wider than lateral formation areas of the second guide slopes 30 along the right and left edge parts 27, 28.

The detection hole 31 allowing the probe 50 for conduction test to be inserted into the terminal accommodation chamber 22 from front is formed to penetrate through the front wall portion 23. The detection hole 31 penetrates through the front wall portion 23 in the front-back direction and extends from the front surface of the housing 20 (front wall portion 23) to communicate with the terminal accommodation chamber 22. As shown in FIG. 2, in a front view, the detection hole 31 is arranged to be obliquely displaced to a right-upper side with respect to the tab insertion hole 24. The detection hole 31 has a substantially rectangular opening shape. The detection hole 31 communicates with a right-upper corner part of the opening area of the tab insertion hole 24 at a left-lower corner part in the front view thereof. An inner surface of the detection hole 31 is composed of an upper surface 32, a lower surface 33, a right side surface 34, a left side surface 35 and an arcuate surface 36. The flat upper surface 32 and the flat left side surface 35 are connected at a right angle. The flat lower surface 33 and the flat right side surface 34 are also connected at a right angle. The arcuate surface 36 has a quarter-circular shape and is smoothly connected to the upper surface 32 and the right side surface 34.

The upper surface 32 of the detection hole 31 is connected flush with an upper wall surface 37 of the terminal accommodation chamber 22, the right side surface 34 of the detection hole 31 is connected flush with a right wall surface 38 of the terminal accommodation chamber 22, and the arcuate surface 36 of the detection hole 31 is connected flush with an arcuate wall surface 39 of the terminal accommodation chamber 22. As shown in FIG. 2, the left side surface 35 of the detection hole 31 is an area serving as a right end surface of the upper edge part 25 constituting the opening edge part of the tab insertion hole 24 and is a flat surface perpendicular to a length direction of the upper edge part 25. Further, the lower surface 33 of the detection hole 31 is an area serving as an upper end surface of the right edge part 27 constituting the opening edge part of the tab insertion hole 24 and is a flat surface perpendicular to a length direction of the right edge part 27.

The front surface of the front wall portion 23 is formed with a recess 40 by recessing an area of the substantially rectangular opening edge of the detection hole 31 extending along the upper surface 32, the arcuate surface 36 and the right side surface 34. A tapered guiding slope 41 for guiding the probe 50 into the detection hole 31 when the probe 50 is displaced upwardly or rightwardly with respect to the detection hole 31 is formed on the front surface of this recess 40.

Further, since the tab insertion hole 24 and the detection hole 31 communicate in an area of the opening area of the tab insertion hole 24 which an upper end part of the right edge part 27 and a right end part of the upper edge part 25 are facing, the upper end part of the right edge part 27 and the right end part of the upper edge part 25 are not directly connected. That is, in a part of the front wall portion 23 where the tab insertion hole 24 and the detection hole 31 communicate, the upper end part of the right edge part 27 facing the detection hole 31 is obliquely projecting to a left-upper side in a cantilever manner and the right end part of the upper edge part 25 facing the detection hole 31 is obliquely projecting to a right-lower side in a cantilever manner. Since the strength of the front wall portion 23 is low in these projecting parts, a means for increasing the strength of the front wall portion 23 is desired.

Accordingly, in this embodiment, the formation area of the second guide slope 30 in the lateral direction perpendicular to the right edge part 27 is suppressed to a range narrower than a lateral opening area (cut area) of the detection hole 31 on the right edge part 27 connected to the detection hole 31. By this configuration, a part of the upper end part of the right edge part 27 of the front wall portion 23 becomes a thick part not formed with the second guide slope 30. By forming the thick part in this way, a reduction in the strength of the upper end part of the right edge part 27 is suppressed.

The terminal fitting 10 is inserted into the terminal accommodation chamber 22 from behind. When being inserted to a proper position to come into contact with the front wall portion 23, the terminal fitting 10 is retained by a locking action of a locking lance 42. With the terminal fitting 10 inserted, a right-upper corner part of the front end surface of the rectangular tube portion 11 is exposed forward of the housing 20 in the detection hole 31. Further, the other area of the front end surface of the rectangular tube portion 11 not exposed from the detection hole 31 is covered by the front wall portion 23 (i.e. upper edge part 25, lower edge part 26, right edge part 27 and left edge part 28).

After the terminal fitting 10 is inserted into the terminal accommodation chamber 22, a conduction test is conducted using the probe 50. As shown in FIG. 2, the probe 50 is in the form of a long and narrow pin having a circular cross-section. During the conduction test, the probe 50 is inserted into the detection hole 31 from the front of the housing 20. If the terminal fitting 10 is inserted to a proper insertion position, an insertion end of the probe 50 comes into contact with the rectangular tube portion 11. Further, if the terminal fitting 10 is left at an incomplete insertion position having a smaller insertion depth than the proper insertion position, the probe 50 does not come into contact with the rectangular tube portion 11 even if being inserted into the detection hole 31. Thus, an inserted state of the terminal fitting 10 can be detected based on whether or not the probe 50 comes into contact with the rectangular tube portion 11. Further, if an electrical conduction is established with the probe 50 held in contact with the terminal fitting 10, whether or not the terminal fitting 10 is inserted in a predetermined terminal accommodation chamber 22 can be detected.

After the conduction test of the connector C is finished, the terminal fitting 10 and the mating terminal 60 are connected. At this time, the tab 61 of the mating terminal 60 is inserted into the tab insertion hole 24 from the front of the housing 20 and resiliently comes into contact with the resilient contact piece 12 in the rectangular tube portion 11. If the tab 61 is vertically or laterally displaced when being inserted, it slides in contact with the guide slope 29, 30 and is guided into the tab insertion hole 24 by the inclination of the guide slope 29, 30.

In this embodiment, the right end part of the upper edge part 25 connected to the detection hole 31 out of the four edge parts 25 to 28 constituting the opening edge part of the tab insertion hole 24 is cut by the detection hole 31. Thus, the formation area of the first guide slope 29 on the upper edge part 25 is made smaller by as much as a part cut by the detection hole 31. However, if the entire width of the tab insertion hole 24 and the width of the upper edge part 25 are compared, a dimensional difference thereof (i.e. narrowed dimension of the formation area of the first guide slope 29 by the detection hole 31) is suppressed to be smaller than an opening width of the detection hole 31.

Since the upper end part of the right edge part 27 is also similarly cut by the detection hole 31, the formation area of the second guide slope 30 on the right edge part 27 is made smaller by as much as a part cut by the detection hole 31. However, if the entire height of the tab insertion hole 24 and the height of the right edge part 27 are compared, a dimensional difference thereof (i.e. narrowed dimension of the formation area of the second guide slope 30 by the detection hole 31) is suppressed to be smaller than an opening height of the detection hole 31.

If the detection hole communicates with only any one of the edges unlike this embodiment, a dimension of a part of the edge part cut by the detection hole (i.e. narrowed dimension of the formation area of the guide slope) is equal to the entire opening dimension of the detection hole 31. Contrary to this, in this embodiment, dimensions of the parts of the upper and right edge parts 25, 27 connected to the detection hole 31 out of the opening edge part of the tab insertion hole 24 cut by the detection hole 31 are suppressed to be smaller than the entire dimensions of the opening area of the detection hole 31. Thus, the formation areas of the guide slopes 29, 30 on the upper and right edge parts 25, 27 connected to the detection hole 31 can be ensured over a wide range.

Further, an area (left side surface 35) of the inner surface of the detection hole 31 serving as an end surface of the upper edge part 25 constituting the opening edge part of the tab insertion hole 24 is a flat surface perpendicular to the length direction of the upper edge part 25 and an area (lower surface 33) of the inner surface of the detection hole 31 serving as an end surface of the right edge part 27 constituting the opening edge part of the tab insertion hole 24 is a flat surface perpendicular to the length direction of the right edge part 27. According to this configuration, the formation area of the guide slope 30 on the upper edge part 25 can be maximally ensured in the length direction (lateral direction) of the upper edge part 25 and the formation area of the guide slope 30 on the right edge part 27 can be maximally ensured in the length direction (vertical direction) of the right edge part 27.

Further, the upper surface 32 of the inner surface of the detection hole 31 is connected flush with the upper wall surface 37 of the terminal accommodation chamber 22, the right side surface 34 of the detection hole 31 is connected flush with the right wall surface 38 of the terminal accommodation chamber 22, and the arcuate surface 36 of the detection hole 31 is connected flush with the arcuate wall surface 39 of the terminal accommodation chamber 22. According to this configuration, there is no step between the inner surface of the detection hole 31 (upper surface 32, right side surface 34 and arcuate surface 36) and that of the terminal accommodation chamber 22 (upper wall surface 37, right wall surface 38 and arcuate wall surface 39). Thus, even if the front end of the rectangular tube portion 11 of the terminal fitting 10 is located slightly behind that of the terminal accommodation chamber 22, the probe 50 can reach the front end of the rectangular tube portion 11 without being caught.

The present invention is not limited to the above described and illustrated embodiment. For example, the following embodiments are also included in the technical scope of the present invention.

In the above embodiment, on the right edge part connected to the detection hole out of the four edge parts constituting the opening edge part of the tab insertion hole, the formation area of the guide slope in the lateral direction perpendicular to the length direction of the right edge part is in a range smaller than the opening area (cut area) of the detection hole. However, without limitation to this, the formation area of the guide slope may be in the same range as the opening area of the detection hole (cut area) or may be in a range larger than the opening area (cut area) of the detection hole.

In the above embodiment, the areas of the inner surface of the detection hole serving as the end surfaces of the upper and right edge parts constituting the opening edge part of the tab insertion hole are flat surfaces perpendicular to the length directions of those edge parts. However, without limitation to this, the area of the inner surface of the detection hole serving as the end surface of the edge part constituting the opening edge part of the tab insertion hole may be a flat surface oblique to the length direction of that edge part.

Although the inner surface of the detection hole and that of the terminal accommodation chamber are connected flush with each other, the inner surface of the detection hole and that of the terminal accommodation chamber may form a step.

LIST OF REFERENCE SIGNS

C . . . connector
10 . . . terminal fitting
20 . . . housing
22 . . . terminal accommodation chamber
23 . . . front wall portion
24 . . . tab insertion hole
27 . . . right edge part (edge part connected to detection hole)
29 . . . first guide slope
30 . . . second guide slope
31 . . . detection hole
50 . . . probe
60 . . . mating terminal
61 . . . tab

The invention claimed is:

1. A connector, comprising:

a housing formed with a front wall and a terminal accommodation chamber rearward of the front wall, the front wall having a front surface;

a terminal fitting to be inserted into the terminal accommodation chamber from behind;

a rectangular tab insertion hole penetrating through the front wall of the housing and allowing a tab of a mating terminal to be inserted in a rearward direction into the terminal accommodation chamber, the rectangular tab insertion hole having opposed first and second edges and opposed third and fourth edges, the fourth edge extending between the first and second edges;

guide slopes formed by recessing and tapering the front surface of the front wall toward the tab insertion hole, the guide slopes including first, second, third and fourth guide slopes extending from the front surface of the front wall to the respective first, second, third and fourth edges of the tab insertion hole; and a detection hole penetrating through the front wall at a position where the first and third guide slopes are substantially adjacent to one another, the detection hole communicating with a corner part of the tab insertion hole and allowing a probe for conduction test to be inserted in the rearward direction into the terminal accommodation chamber.

2. The connector of claim 1, wherein a width of the third guide slope in a direction perpendicular to a length direction of the third edge part of the tab insertion hole is in smaller than an opening area of the detection hole.

3. The connector of claim 2, wherein an area of an inner surface of the detection hole adjacent the third edge of the tab insertion hole is a flat surface perpendicular to the third edge of the tab insertion hole.

4. The connector of claim 3, wherein an inner surface of the detection hole and an inner surface of the terminal accommodation chamber are connected flush with each other.

5. The connector of claim 1, wherein an area of an inner surface of the detection hole adjacent the first edge of the tab insertion hole is a flat surface perpendicular to the first edge of the tab insertion hole.

6. The connector of claim 5, wherein an inner surface of the detection hole and an inner surface of the terminal accommodation chamber are connected flush with each other.

7. The connector of claim 1, wherein an inner surface of the detection hole and an inner surface of the terminal accommodation chamber are connected flush with each other.

8. The connector of claim 1, further comprising a detection hole guide slope recessed and tapering from the front surface of the front wall toward the detection hole.

9. The connector of claim 1, wherein the first and second edges of the tab insertion hole are longer than the third and fourth edges of the tab insertion hole.

* * * * *